US009641944B2

(12) United States Patent
Johnson et al.

(10) Patent No.: US 9,641,944 B2
(45) Date of Patent: May 2, 2017

(54) METHOD OF TUNING CAPACITANCE FOR HEARING ASSISTANCE DEVICE FLEX ANTENNA

(71) Applicant: Starkey Laboratories, Inc., Eden Prairie, MN (US)

(72) Inventors: Andrew Joseph Johnson, Edina, MN (US); Scott Jacobs, Eden Prairie, MN (US); Stephen Paul Flood, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 799 days.

(21) Appl. No.: 13/969,270

(22) Filed: Aug. 16, 2013

(65) Prior Publication Data

US 2015/0049891 A1 Feb. 19, 2015

(51) Int. Cl.

| | |
|---|---|
| ***H04R 25/00*** | (2006.01) |
| ***H01Q 1/27*** | (2006.01) |
| ***H01Q 1/38*** | (2006.01) |
| ***H01Q 7/00*** | (2006.01) |

(52) U.S. Cl.

CPC ..... *H04R 25/554* (2013.01); *H01Q 1/273* (2013.01); *H01Q 1/38* (2013.01); *H01Q 7/005* (2013.01); *H04R 25/608* (2013.01); *H04R 2225/021* (2013.01); *H04R 2225/025* (2013.01); *H04R 2225/51* (2013.01); *Y10T 29/49018* (2015.01)

(58) Field of Classification Search

CPC .... H04R 25/554; H04R 25/608; H01Q 7/005; H01Q 1/273; H01Q 1/38; Y10T 29/49018

See application file for complete search history.

(56) References Cited

U.S. PATENT DOCUMENTS 4,593,412 A * 6/1986 Jacob ..... H04B 1/04 343/793
5,072,233 A 12/1991 Zanzig
6,075,707 A * 6/2000 Ferguson ..... G06K 19/04 174/254

(Continued)

FOREIGN PATENT DOCUMENTS

EP 1708306 A1 10/2006
WO WO-2012171573 A1 12/2012

OTHER PUBLICATIONS

"DuPont™ Pyralux® AP flexible circuit materials", [Online] Retrieved from the Internet:<URL: http://www.dupont.com/content/dam/assets/products-and-services/electronic-electrical-materials/assets/Pyralux_AP-Plus_DataSheet.pdf, (Accessed Mar. 19, 2015), 9 pgs.

(Continued)

*Primary Examiner* — Peter DungBa Vo
*Assistant Examiner* — Jeffrey T Carley
(74) *Attorney, Agent, or Firm* — Schwegman, Lundberg & Woessner, P.A.

(57) ABSTRACT

Disclosed herein, among other things, are systems and methods for tuning hearing assistance device antennas. One aspect of the present subject matter includes a method including providing a flexible antenna for a hearing assistance device. The flexible antenna includes at least one variable distributed tuning element embedded in the flexible antenna, in various embodiments. According to various embodiments, the tuning element is configured for tuning the flexible antenna for wireless hearing assistance device communication.

19 Claims, 8 Drawing Sheets

(56) References Cited

U.S. PATENT DOCUMENTS

| | | | | |
|---|---|---|---|---|
| 6,407,669 | B1 * | 6/2002 | Brown | G06K 19/0726 340/10.1 |
| 2003/0016133 | A1 * | 1/2003 | Egbert | G06K 19/0726 340/572.7 |
| 2007/0080889 | A1 * | 4/2007 | Zhang | H01Q 1/273 343/895 |
| 2010/0158295 | A1 | 6/2010 | Polinske et al. | |
| 2011/0009925 | A1 * | 1/2011 | Leigh | A61N 1/36032 607/60 |
| 2012/0260500 | A1 | 10/2012 | Zhou | |

OTHER PUBLICATIONS

"European Application Serial No. 14181096.0, Extended European Search Report mailed Feb. 17, 2015", 6 pgs.

* cited by examiner

METHOD OF TUNING CAPACITANCE FOR HEARING ASSISTANCE DEVICE FLEX ANTENNA

TECHNICAL FIELD

This document relates generally to hearing assistance systems and more particularly to methods and apparatus for embedded tuning capacitance for a hearing assistance device flex antenna.

BACKGROUND

Modern hearing assistance devices, such as hearing aids, are electronic instruments worn in or around the ear that compensate for hearing losses of hearing-impaired people by specially amplifying sounds. The sounds may be detected from a patient's environment using a microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. The hearing aids may each include an antenna for the wireless communication. Loop antenna inductance can require additional tuning elements to resonate the antenna.

Accordingly, there is a need in the art for improved systems and methods for tuning hearing assistance device antennas.

SUMMARY

Disclosed herein, among other things, are systems and methods for tuning hearing assistance device antennas. One aspect of the present subject matter includes a method of tuning a flexible antenna for a hearing assistance device, the method including placing a metallic trace on the flexible antenna to provide a variable distributed capacitor connected in parallel to one of a plurality of feed lines of the antenna. In various embodiments, a portion of the metallic trace is cut to adjust the variable distributed capacitor for tuning the flexible antenna for wireless hearing assistance device communication.

One aspect of the present subject matter includes a method including providing a flexible antenna for a hearing assistance device. The flexible antenna includes at least one variable distributed inductor embedded in the flexible antenna, in various embodiments. According to various embodiments, the variable distributed inductor includes a printed inductor and is configured for tuning the flexible antenna for wireless hearing assistance device communication.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
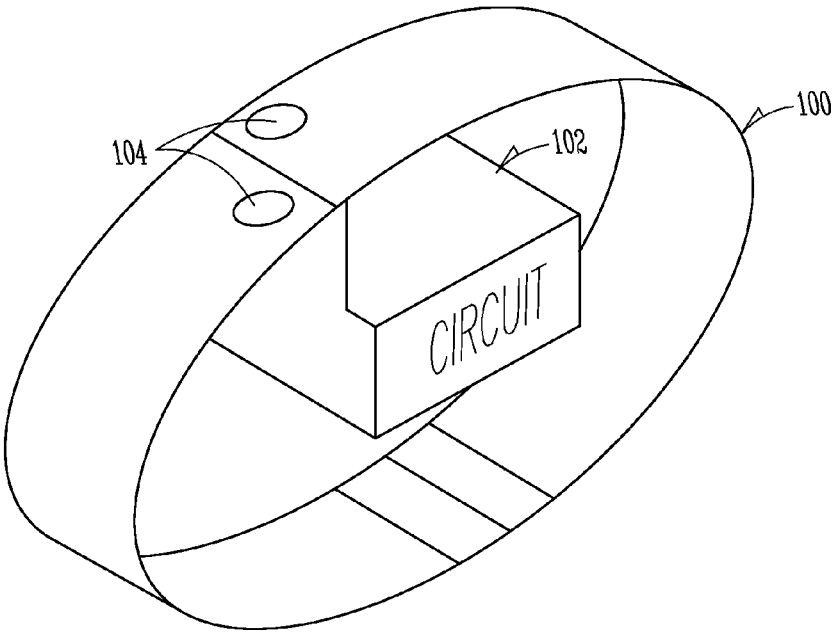
FIG. 1 illustrates a flexible loop antenna for a hearing assistance device, according to various embodiments of the present subject matter.
Figure 2A:
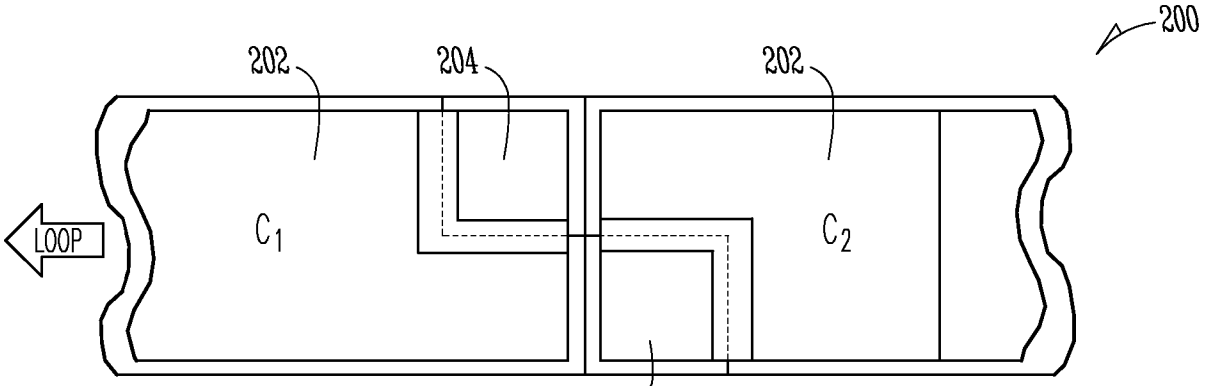
FIGS. 2A-2D illustrate parallel plate capacitors embedded in a flexible antenna for a hearing assistance device, according to various embodiments of the present subject matter.
Figure 2B:
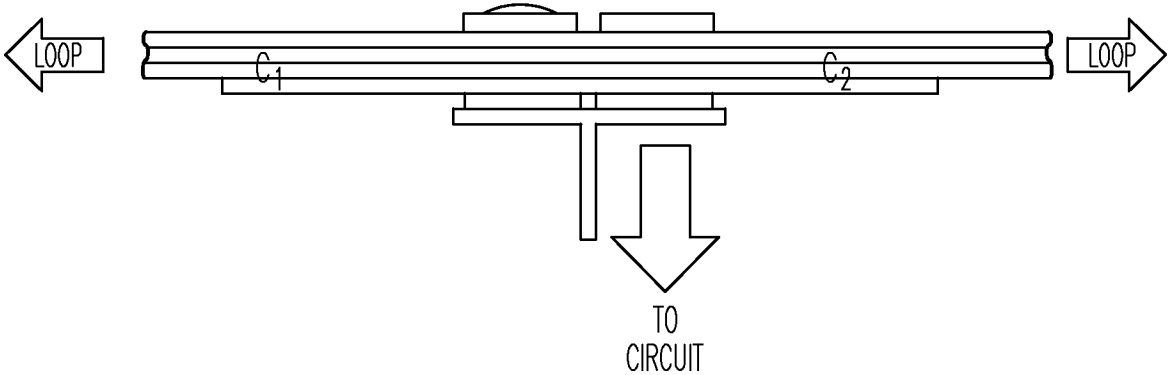
Figure 2C:
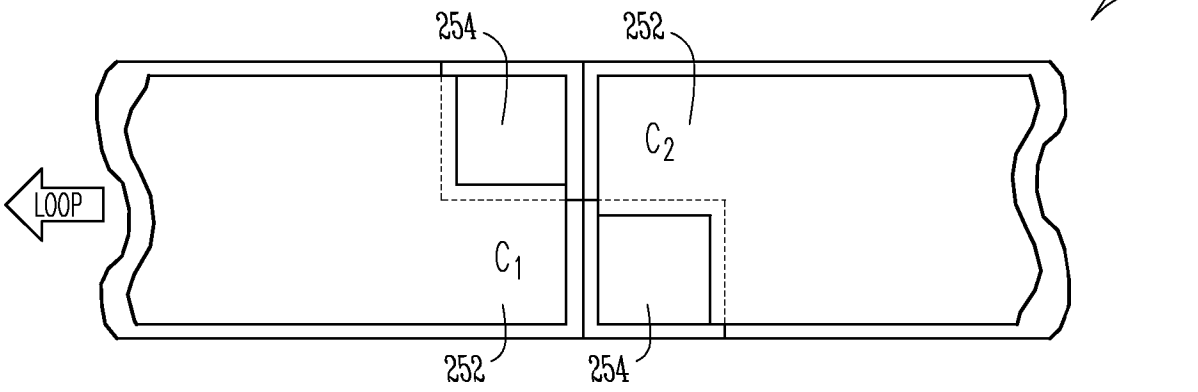
Figure 2D:
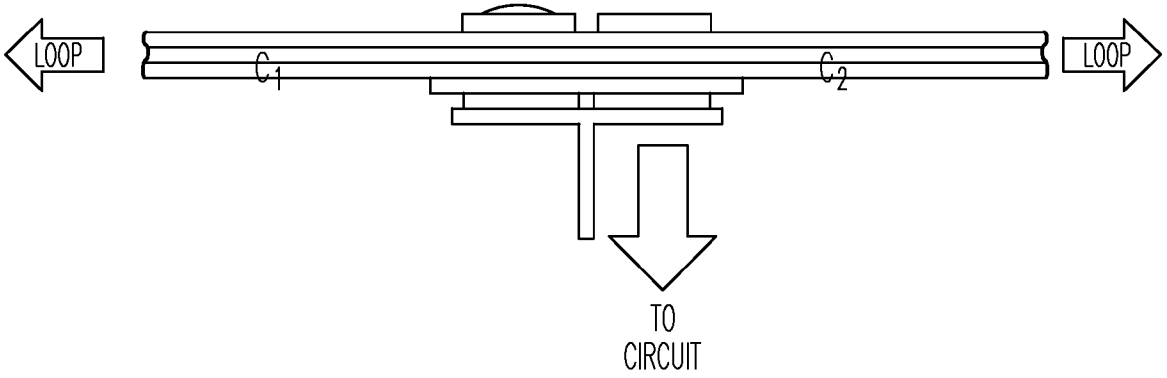

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing aids are electronic instruments worn in or around the ear that compensate for hearing losses of hearing-impaired people by specially amplifying sounds. The sounds may be detected from a patient's environment using a microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. The hearing aids may each include an antenna for the wireless communication. Loop antenna inductance can require additional tuning elements to resonate the antenna.

Previous solutions for tuning a hearing assistance device antenna include making the antenna sensitive enough that the radio can tune for each region with no change in hardware, or making changes for different regions with varying tuning elements. Lowering the Q to increase the antenna bandwidth is another solution, but this can reduce receiver radio frequency (RF) sensitivity and transmitter effective radiated power (ERP). However, not all antennas can achieve the performance necessary to tune to multiple regions, and there is added cost and size to adding the discrete tuning elements. Thus, manufacturing broadband antennas is difficult, especially in already constrained situations. One previous solution includes a large metal rod loop antenna with a moveable parallel plate capacitor for dynamic tuning, and a mechanically moveable parallel plate capacitor for the purpose of adjusting the self-resonant frequency.

Disclosed herein, among other things, are systems and methods for tuning hearing assistance device antennas. One aspect of the present subject matter includes a hearing assistance device including a flexible antenna and a variable distributed tuning element embedded in the flexible antenna. According to various embodiments, the variable distributed tuning element is configured for tuning the flexible antenna for wireless hearing assistance device communication. Benefits of the present subject matter include to reduce size, component count, and the need for multiple motherboards.

One aspect of the present subject matter includes a method of tuning a flexible antenna for a hearing assistance device, the method including placing a metallic trace on the flexible antenna to provide a variable distributed capacitor connected in parallel to one of a plurality of feed lines of the antenna. In various embodiments, a portion of the metallic trace is cut to adjust the variable distributed capacitor for tuning the flexible antenna for wireless hearing assistance device communication.

Previous solutions used dielectric grease between the parallel plates and relied on machined parts to maintain the spacing of the plates. Various embodiments of the present subject matter use the polyimide of the flexible printed circuit board (PCB) for much tighter tolerance on the spacing, more homogenous and predictable dielectric constant, and more resilience to temperature. The scale of this embedded capacitor/antenna combo is much smaller and realized with copper traces on a flexible PCB for use in a hearing aid rather than constructed from large metal rods for general purpose use, in various embodiments. If a capacitive tuning element is needed, the present subject matter removes the discrete tuning component and embeds it in the main hearing aid flex circuit or antenna circuit in a way that saves cost and space while providing an especially tightly controlled and temperature-stable high-Q capacitor. If an inductive tuning element is needed, the present subject matter provides a way of removing the discrete inductive tuning element with a printed inductor on the flexible circuit, in an embodiment. Antenna matching using embedded capacitive equivalent elements into a fabricated board saves space and allows more flexibility for the mechanical designer. Tuning elements can encroach upon the bend radius areas of the flexible circuit or flexible antenna. The present subject matter removes quality problems seen on the flexible circuit where the solder joints can break due to stress of the bend, in various embodiments.

The present subject matter reduces size by moving the capacitance (or other passive element) into the flex circuit or flex antenna in a way that it adds no size. This also reduces cost by removing a discrete purchased component that is now included in a flexible circuit board, and reduces size further by eliminating solder pads. The present subject matter improves performance by providing a capacitor that has a tighter value tolerance and more stable value over temperature than multilayer chip capacitors. The present subject matter decreases the overall size of the flex circuit by taking advantage of the bending area of the flex that was not previously accessible for placing tuning elements, in various embodiments. The present subject matter also improves circuit quality by removing stress from the solder joints to the discrete tuning elements.

Various embodiments include parallel plate capacitors embedded into the antenna or main flex circuit. Two parallel layers of copper separated by a thin uniform layer of polyimide provide a tightly controlled capacitor that takes little extra space and has negligible extra cost. The capacitance value is made very precise accounting for lithographic tolerance, in various embodiments. The fabricated board also has dimensional stability over temperature which translates to very low changes in capacitance over temperature ranges. In various embodiments, the embedded capacitance can be put in the large bend area region which currently cannot support surface mount components, meaning layouts can be compacted, with the possibility to fit more circuits per panel.

Another embodiment of the present subject matter adds a printed inductor to the flexible circuit or flexible antenna design. Similar to the capacitor, the inductor can be fabricated on an additional layer of the flexible circuit, including the bend radius region, in various embodiments.

FIG. 1 illustrates a flexible loop antenna 100 for a hearing assistance device, according to various embodiments of the present subject matter. Hearing aid antennas, which include a loop radiating element in various embodiments, are designed for the 700-1100 MHz frequency range and typically wrap around a hearing aid circuit 102 to achieve the largest possible aperture or area inside the loop. In various embodiments, copper forms the loop antenna 100 with a break between two solder areas 104 or circles, which connect the antenna to feed lines to the radio transmission and receptions circuitry, or radio. The antenna loop is inductive and the hearing assistance device implementation requires additional tuning elements to resonate the antenna. Previously, the tuning element was usually discrete capacitors or inductors. The tuning element is often close to a bend radius, where stress of the bend can lead to a failure of the solder joints of the discrete tuning element. The present subject matter removes the discrete tuning element and replaces it with a distributed tuning element. An embedded tuning element is not subject to failure from the flexible circuit stresses that are in the bend radius of the design.

The present subject matter provides a single circuit design and different resonant frequencies can be achieved by varying antenna geometry. Adding discrete components to the antenna is undesirable because of the added size, processing steps, and costs, and can be avoided using variable distributed tuning elements of the present subject matter. The present subject matter provides a smaller size by reducing parts and taking advantage of the bend region, and saves cost of extra tuning elements. In addition, the present subject matter provides more robust capacitors with tighter tolerances and lower temperature dependency.

Figure 3A:
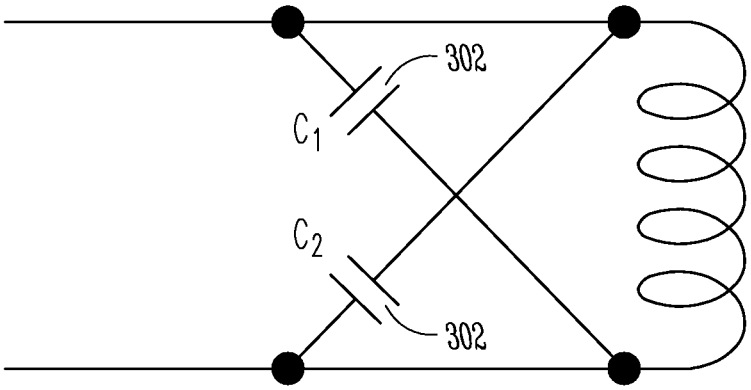
FIGS. 3A-3B illustrate equivalent circuit diagrams of the parallel plate capacitors of FIGS. 2A-2B, according to various embodiments of the present subject matter.
Figure 3B:
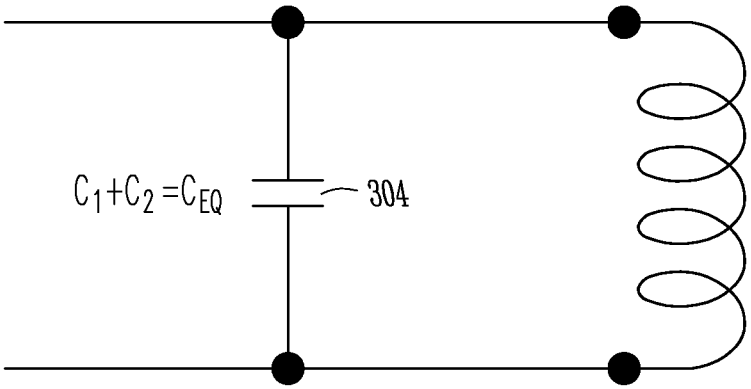

FIGS. 2A-2D illustrate top and side views of parallel plate capacitors 202, 252 embedded in a flexible antenna 200, 250 for a hearing assistance device, according to various embodiments of the present subject matter. In various embodiments, an antenna loop with a small gap in copper between the feed-line solder pads 204, 254 is provided. By bridging from this solder pad over the gap on a different layer, parallel plate capacitors are effectively in parallel with the feed lines, in various embodiments. Since $C=\epsilon A/d$, if the polyimide ($\epsilon_r=3.5$) dielectric is 0.001" (25.4 microns) thick, there are many possible geometries and dimensions of these parallel plates can provide parallel capacitance values from less than one to dozens of picofarads. FIGS. 3A-3B illustrate equivalent circuit diagrams of the parallel plate capacitors 302, 304 of FIGS. 2A-2C, according to various embodiments of the present subject matter. Various examples include two parallel plates that are the same size, so that the greatest source of capacitor variation is the layer to layer alignment plus etching errors.

Figure 4:
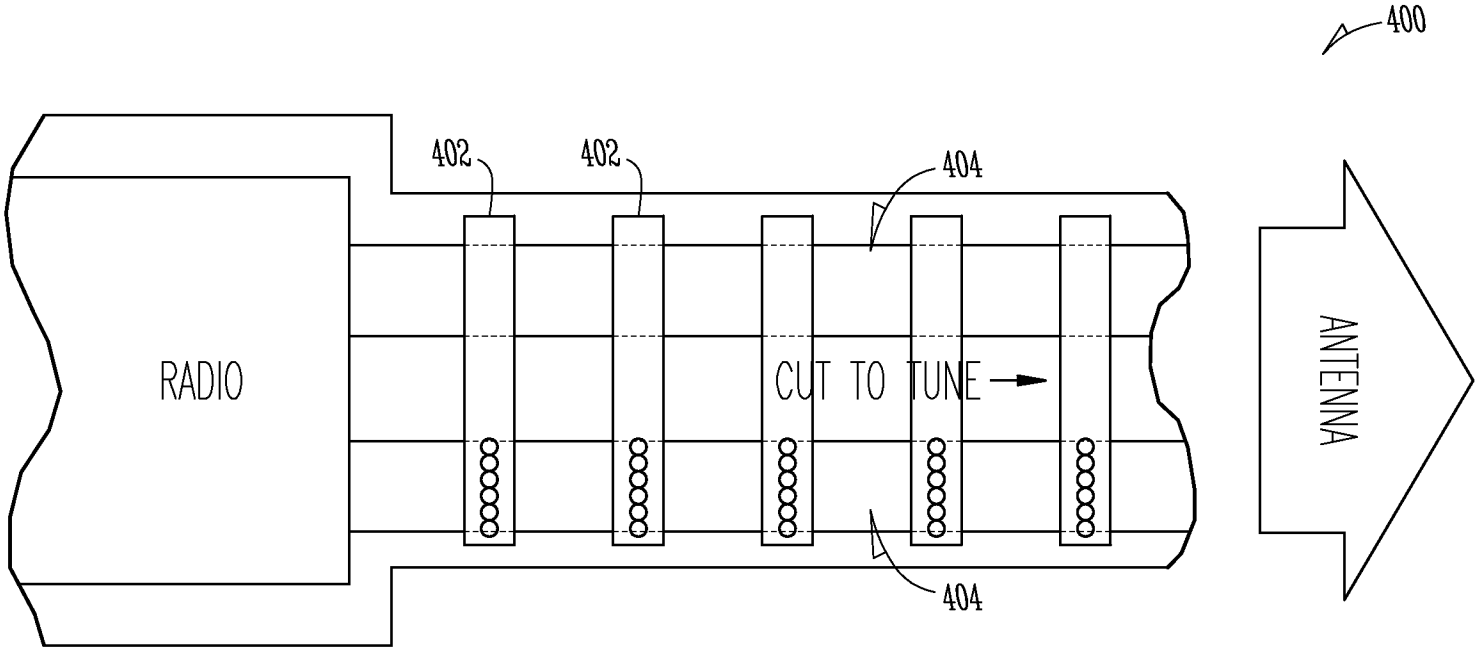
FIG. 4 illustrates a plurality of parallel plate capacitors embedded in a flexible antenna for a hearing assistance device, according to various embodiments of the present subject matter.

FIG. 4 illustrates a plurality of parallel plate capacitors embedded in a flexible antenna 400 for a hearing assistance device, according to various embodiments of the present subject matter. By stringing a number of small (0.003" wide, for example) strips 402 across the feed lines 404 and connecting them to one of the feed lines, a number of 0.14 pF parallel capacitors can be formed (assuming 30 mil feed line width). This allows different tuning values by cutting a fraction of these capacitors with a laser or scalpel. This means devices may be tuned manually, or, once the appropriate value is determined, tuned automatically with a laser, in various embodiments. An additional advantage of a trimmable configuration, such as shown in FIG. 4, includes allowing for the antenna and motherboard to be on one flexible circuit, instead of separate circuits that would need to be attached during manufacture. This further reduces the size and component count while also reducing the parasitic elements present in the solder connection and assembly steps.

Many sizes and shapes of capacitor can be used, and the embedded tuning elements can be placed in the flex antenna or in the main circuit. Any antenna can use this tuning method, whether single or multiple feeds, dipole, monopole, loop, fractal, etc., and the present subject matter can use alternate frequency bands, as well (e.g. 100 MHz, 2.4 GHz, etc.). Various embodiments include a single antenna with a strip of overlap for capacitance that is cut or stripped to length for multiple regions.

Figure 5:
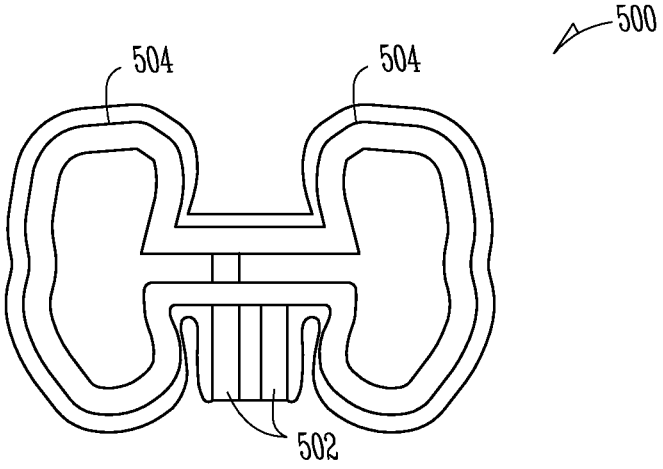
FIG. 5 illustrates a mutually coupled dual small loop antenna array for a hearing assistance device, according to various embodiments of the present subject matter.

FIG. 5 illustrates a mutually coupled dual small loop antenna array for a hearing assistance device, according to various embodiments of the present subject matter. The antenna topology, commonly referred to as a butterfly loop antenna 500, includes mother board feed lines 502 attached to parallel loops 504, in various embodiments, and includes embedded capacitance of the present subject matter.

Figure 6B:
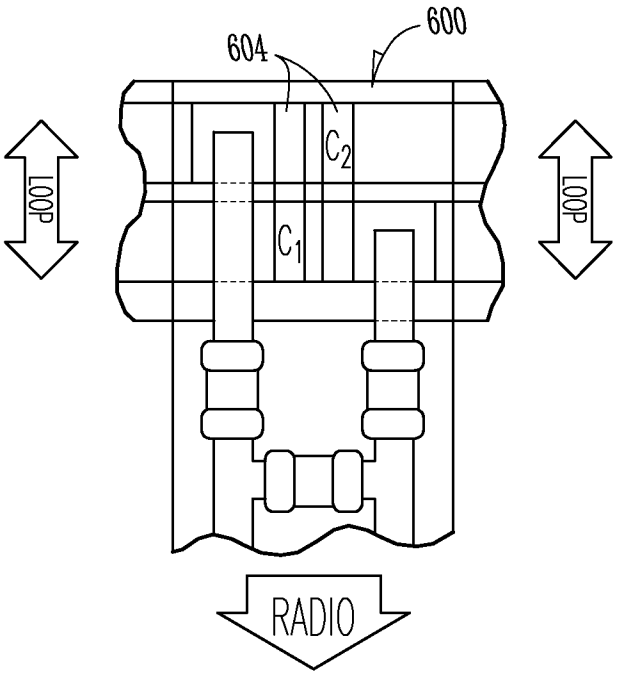
FIGS. 6A-6B illustrate feed lines and capacitance layout for a flexible antenna for a hearing assistance device, according to various embodiments of the present subject matter.
Figure 6A:
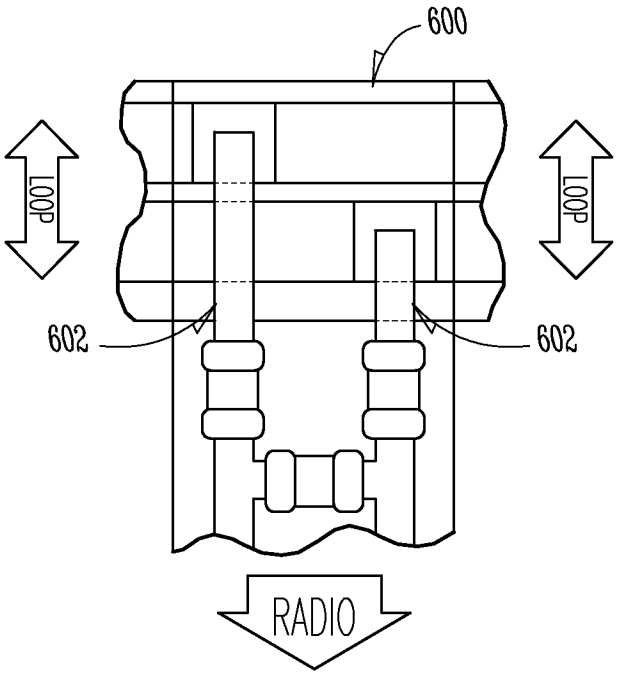
Figure 7:
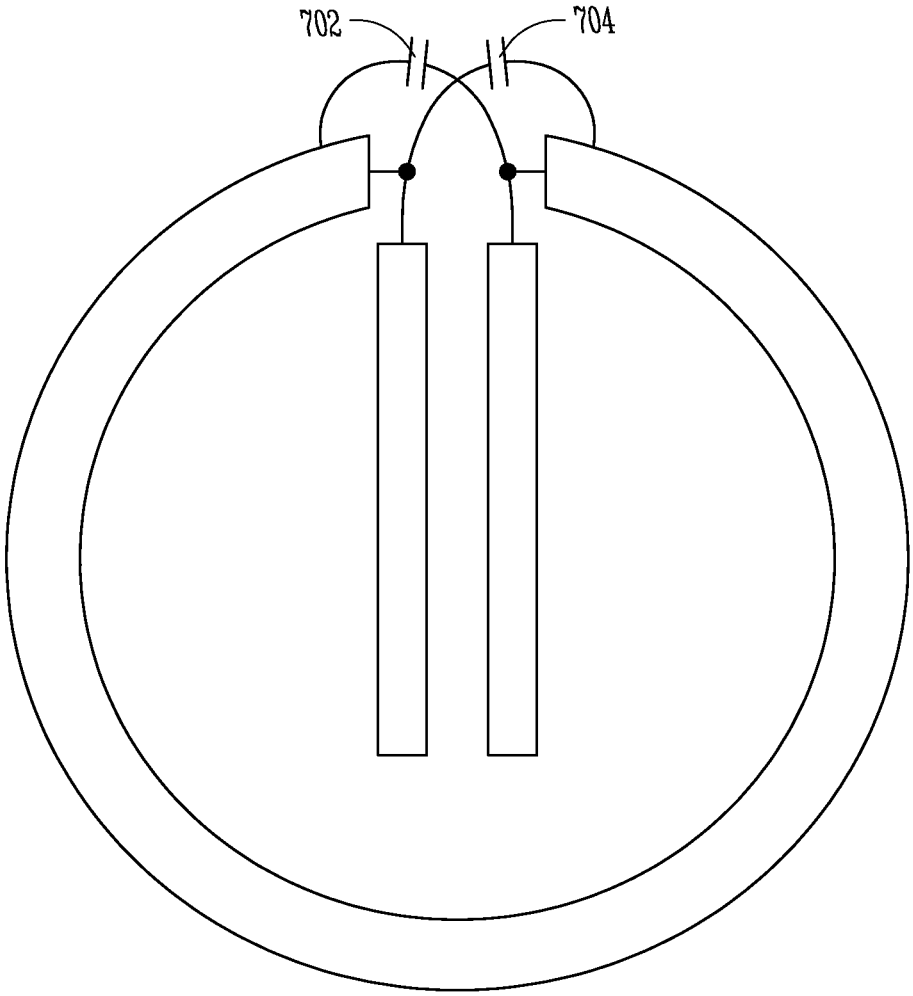
FIG. 7 illustrates an equivalent transmission line model for capacitors embedded in a flexible antenna for a hearing assistance device, according to various embodiments of the present subject matter.

FIGS. 6A-6B illustrate feed lines and capacitance layout for a flexible antenna for a hearing assistance device, according to various embodiments of the present subject matter. FIG. 6A shows a layout of feed lines 602, and FIG. 6B shows an example shunt capacitance 604 of the present subject matter. Another embodiment of the present subject matter is to create larger values of capacitance as bypass caps shunted from the radio supply pin to the ground plane. FIG. 7 illustrates an equivalent transmission line model for capacitors 702, 704 embedded in a flexible antenna for a hearing assistance device, according to various embodiments of the present subject matter.

Various embodiments of the present subject matter include embedded capacitors in a flex antenna with binary weighting, to provide for trimming over a wide range yet maintaining resolution, such as weighting like switchable RF step attenuators at different capacitance levels (e.g. 0.05 pF, 0.1 pF, 0.2 pF, 0.3 pF etc.). Additional embodiments include separate solderable feed lines to the antenna, with the feed line including multiple capacitor value variations to allow re-trimming for optimization and tuning. Various embodiments provide for filtering of harmonics and multi-band matching, tuning and filtering. In some embodiments, interdigitated capacitors can be used, as they are less sensitive to dielectric variations and layer to layer misalignment, but more sensitive to etching tolerance.

The present subject matter can use multiple embedded capacitor (and/or inductor) elements in a flex antenna that are adjustable for unique tuning values for different frequency bands used in different parts of the world. The distributed tuning elements of the present subject matter: remove discrete components, allowing for smaller packaging; remove discrete components from the flex bend radius area, improving quality; reduce costs by not using discrete chip capacitors; and provides for additional elements embedded into the flexible circuit assembly.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), completely-in-the-canal (CIC) or invisible-in-canal (IIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of tuning a flexible antenna for a hearing assistance device; the method comprising:

placing a metallic trace on the flexible antenna of the hearing assistance device to provide a variable distributed capacitor connected in parallel to one of a plurality of feed lines of the antenna, wherein the variable distributed capacitor includes a bypass capacitor shunted from a radio supply pin to a ground plane;

using the metallic trace to bridge a gap between at least one of one of the plurality of feed lines; and cutting a portion of the metallic trace to adjust size of the variable distributed capacitor for tuning the flexible antenna for wireless hearing assistance device communication.

2. The method of claim 1, further comprising:

adjusting a position of the variable distributed capacitor on the flexible antenna.

3. The method of claim 1; wherein providing a variable distributed capacitor includes providing a parallel plate capacitor.

4. The method of claim 1, wherein the variable distributed capacitor includes a layer of polyimide.

5. The method of claim 4, wherein the variable distributed capacitor includes parallel layers of copper separated by the layer of polyimide.

6. The method of claim 1; wherein the variable distributed capacitor includes a plurality of copper strips across teed lines of the flexible antenna to form a plurality of capacitances.

7. The method of claim 1, wherein the cutting includes using a laser to manually tune the capacitor.

8. The method of claim 1, wherein the cutting includes using a scalpel to manually tune the capacitor.

9. The method of claim 1, wherein the variable distributed capacitor is located at a bend in the flexible antenna.

10. The method of claim 1, wherein the flexible antenna includes an antenna with a strip of overlap for capacitance.

11. The method of claim 1, further comprising providing at least one variable distributed inductor embedded in the flexible antenna, the variable distributed inductor including a printed inductor on the flexible antenna and configured for tuning the flexible antenna for wireless hearing assistance device communication.

12. The method of claim 1, wherein the hearing assistance device includes a cochlear implant.

13. The method of claim 1, wherein the hearing assistance device includes a hearing aid.

14. The method of claim 13, wherein the hearing aid includes a behind-the-ear (BTE) hearing aid.

15. The method of claim 13, wherein the hearing aid includes an in-the-ear (ITE) hearing aid.

16. The method of claim 13, wherein the hearing aid includes an in-the-canal (ITC) hearing aid.

17. The method of claim 13, wherein the hearing aid includes a completely-in-the-canal (CIC) hearing aid.

18. The method of claim 13, wherein the heating aid includes a receiver-in-canal (RIC) hearing aid.

19. The method of claim 13, wherein the hearing aid includes an invisible-in-canal (IIC) hearing aid.

* * * * *